US009981175B2

(12) United States Patent
DeLaRosa

(10) Patent No.: US 9,981,175 B2
(45) Date of Patent: May 29, 2018

(54) TAEKWONDO BAG

(71) Applicant: Dan DeLaRosa, Coral Springs, FL (US)

(72) Inventor: Dan DeLaRosa, Coral Springs, FL (US)

( * ) Notice: Subject to any disclaimer, the term of this patent is extended or adjusted under 35 U.S.C. 154(b) by 0 days. days.

(21) Appl. No.: 14/756,500

(22) Filed: Sep. 11, 2015

(65) Prior Publication Data

US 2016/0074733 A1 Mar. 17, 2016

Related U.S. Application Data

(60) Provisional application No. 62/071,021, filed on Sep. 12, 2014.

(51) Int. Cl.

| | |
|---|---|
| ***A45F 3/04*** | (2006.01) |
| ***A63B 71/00*** | (2006.01) |
| *A63B 71/10* | (2006.01) |
| *A63B 71/12* | (2006.01) |

(52) U.S. Cl.

CPC ..... *A63B 71/0036* (2013.01); *A63B 71/10* (2013.01); *A63B 2071/1208* (2013.01); *A63B 2244/10* (2013.01)

(58) Field of Classification Search

CPC ..... A63B 71/0036; A63B 7/10; A63B 2071/1208; A63B 2244/10; A45F 3/04; A45C 13/02; A42B 3/006; A42B 5/0425

USPC ..... 224/265

See application file for complete search history.

(56) References Cited

U.S. PATENT DOCUMENTS

| | | | | |
|---|---|---|---|---|
| 5,906,277 | A * | 5/1999 | Vienneau | A63C 11/026 206/287.1 |
| 9,015,955 | B2 * | 4/2015 | Vezina | D06F 58/14 211/182 |
| 2009/0283485 | A1 * | 11/2009 | Anderson | A47F 7/19 211/85.3 |
| 2011/0180575 | A1 * | 7/2011 | Abramowitz | A45F 3/04 224/259 |
| 2012/0043229 | A1 * | 2/2012 | Salys | A42B 3/006 206/8 |
| 2014/0202897 | A1 * | 7/2014 | Collins | A45C 3/001 206/315.1 |
| 2014/0291976 | A1 * | 10/2014 | Ford | A63C 11/023 280/814 |

* cited by examiner

*Primary Examiner* — Corey Skurdal
(74) *Attorney, Agent, or Firm* — Dan DeLaRosa

(57) ABSTRACT

The present invention provides for a taekwondo bag comprising: a housing comprising a main compartment and a front panels that closes and opens to access the main compartment, and the main compartment comprising top and bottom portions; and at least one helmet carrier designed to receive an Olympic taekwondo helmet, and the helmet carrier is situated within the main compartment of the housing of the bag.

20 Claims, 5 Drawing Sheets

TAEKWONDO BAG

RELATED APPLICATION

This application is related to U.S. Provisional Patent Application Ser. No. 62/071,021 filed on Sep. 12, 2014 entitled "Taekwondo Bag".

BACKGROUND OF THE INVENTION

Field of the Invention

This invention relates to a Taekwondo bag and more specifically, to a sports bag designed to carry gear and equipment for Olympic style taekwondo.

Description of the Related Art

There are various patents covering sports bags but there is no bag designed specifically to carry Olympic style taekwondo gear and equipment.

SUMMARY OF THE INVENTION

In one embodiment, the present invention provides for a taekwondo bag comprising: a housing comprising a main compartment and front and rear panels that close and open to access the main compartment, the main compartment comprising top and bottom portions; a base situated on the bottom portion of the main compartment, and the base has a securing device designed to receive an Olympic taekwondo chest protector; and at least one helmet carrier designed to receive an Olympic taekwondo helmet, the helmet carrier is situated within the main compartment of the housing of the bag.

In another embodiment, the helmet carrier is attached to the main compartment. In yet another embodiment, the helmet carrier is pivotally attached to a framework within the main compartment of said housing. In still another embodiment, the helmet carrier is slidably attached to a framework within the main compartment of the housing. In still yet another embodiment, the helmet carrier is attached to the base within the main compartment of the housing.

In a further embodiment, the helmet carrier is shaped like a human head. In another further embodiment, the helmet carrier is hollow and provides for additional storage. In yet a further embodiment, the bag further comprises a second helmet carrier, and the second helmet carrier is attached to the main compartment.

In still a further compartment, the bag further comprises at least one secondary compartment. In still yet a further embodiment, the bag further comprises at least one handle for carrying the bag. In another embodiment, the bag further comprises at least one strap for carrying the bag. In a further embodiment, the bag further comprises at least two straps for carrying the bag as a knapsack. In another further embodiment, a user accesses the rear panel to store the chest protector.

In yet another further embodiment, the bag further comprises at least one Olympic taekwondo chest protector and at least one Olympic taekwondo helmet. In another embodiment, the bag further comprises closures and the closure is a zipper.

In a further embodiment, the present invention relates to a taekwondo bag comprising: a housing comprising a main compartment and a front panels that closes and opens to access the main compartment, and the main compartment comprising top and bottom portions; and at least one helmet carrier designed to receive an Olympic taekwondo helmet, and the helmet carrier is situated within the main compartment of the housing of the bag.

In another further compartment, the bag further comprises a base situated on the bottom portion of the main compartment, and the base has a securing device designed to receive an Olympic taekwondo chest protector.

In a further embodiment, the bag further comprises a second helmet carrier designed to receive a second Olympic taekwondo helmet, and the helmet carrier is situated within the main compartment of the housing of the bag. In another further embodiment, the bag further comprises at least one wheel, at least one strap and at least one handle.

In another embodiment, the rear or front side of the bag has two side pockets for inserting a portion of the chest protector for storage. The sides of the chest protector is slipped into the pockets of the bag. In a further embodiment, there are inflatable members for inserting into the helmets for protecting the helmets.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Figure 1:
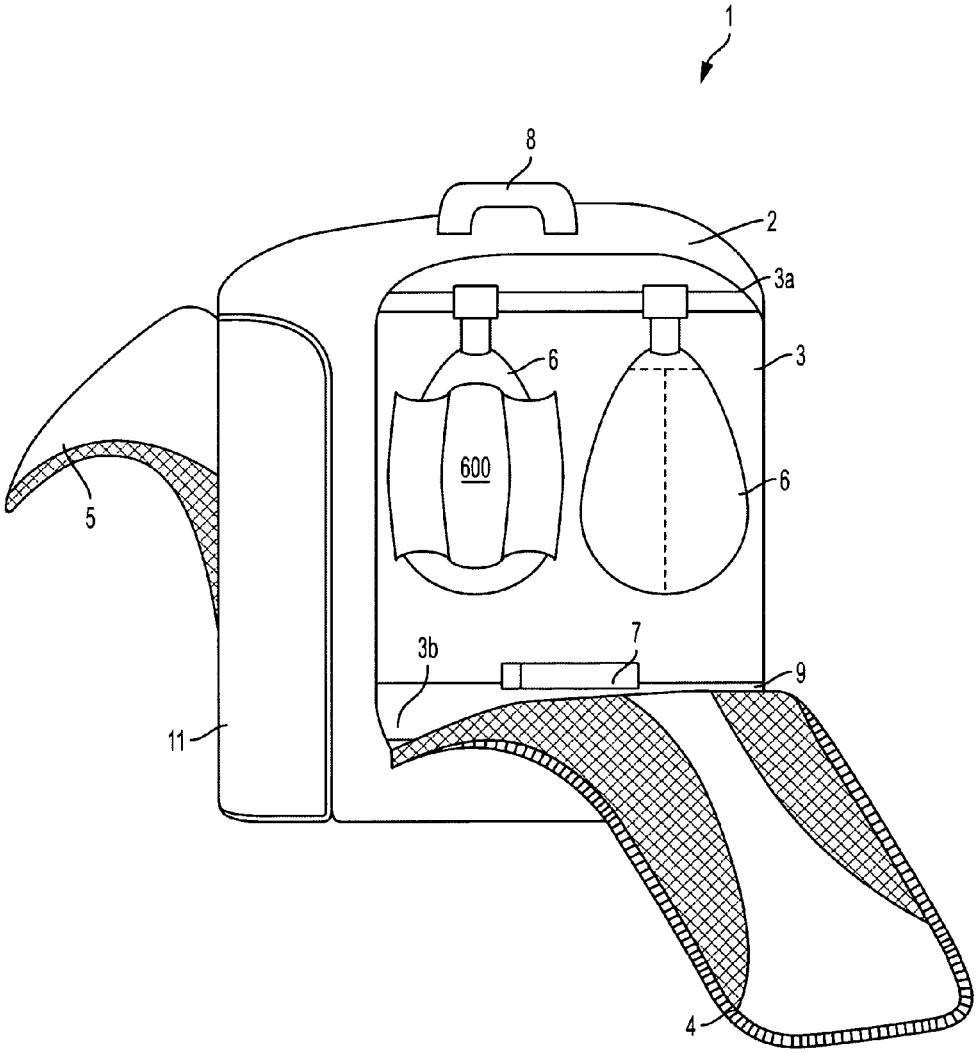
FIG. 1 is a front perspective view of one of the embodiments of the apparatus.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

FIGS. 1-5 illustrate a taekwondo bag 1 comprising: a housing 2 comprising a main compartment 3 and front 4 and rear 5 panels that close and open to access the main compartment 3. The main compartment 3 comprises top 3*a* and bottom 3*b* portions. There is a base 9 situated on the bottom portion 3*b* of the main compartment 3 and the base 9 has a securing device 7 designed to receive an Olympic taekwondo chest protector 200; and at least one helmet carrier 6 designed to receive an Olympic taekwondo helmet 106. The helmet carrier 6 is situated within the main compartment 3 of the housing 2 of the bag 1.

Figure 2:
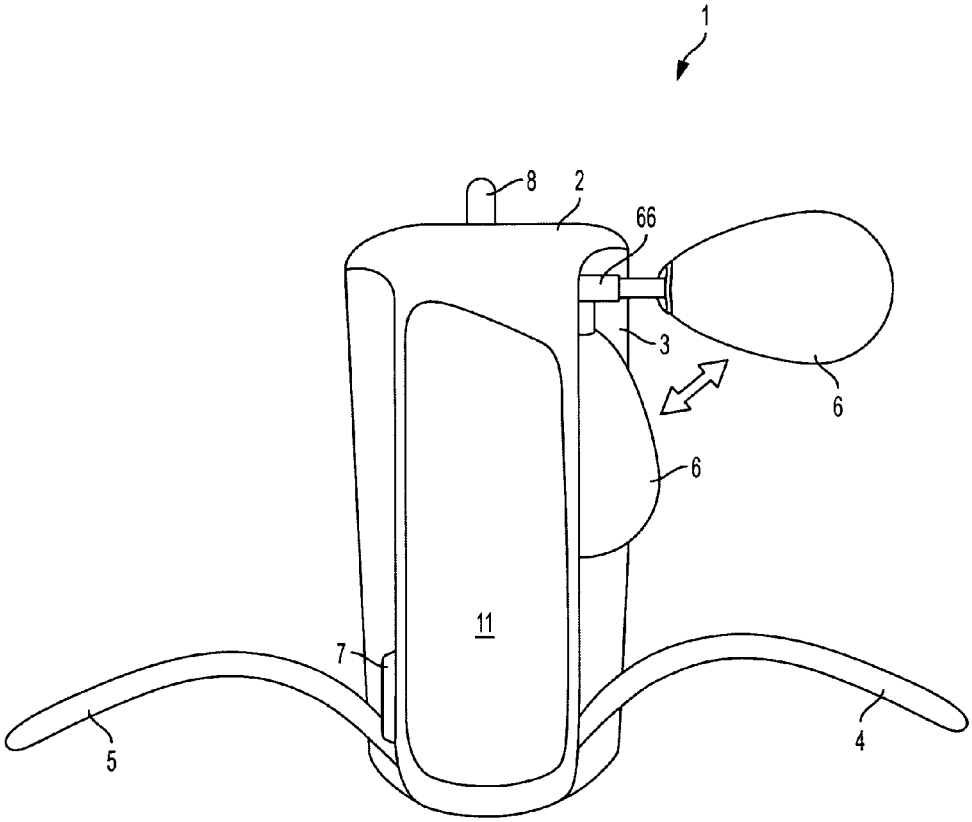
FIG. 2 is a side view of another embodiment where the helmet carriers are pivotally attached to the bag.
Figure 3:
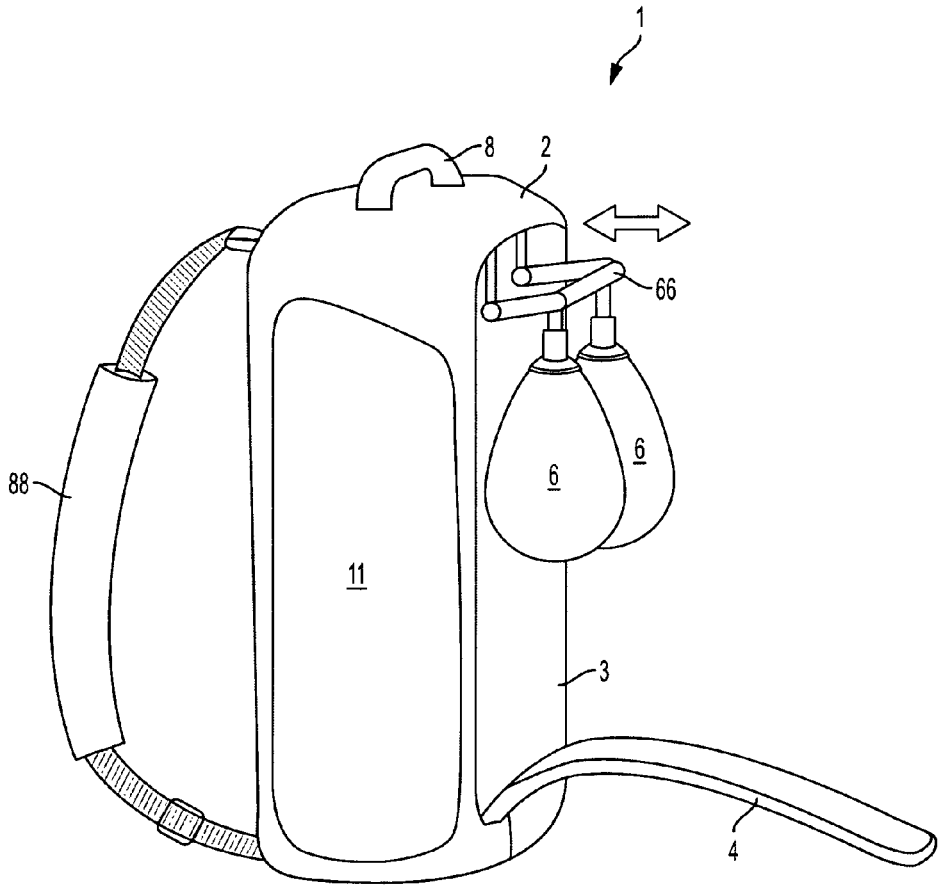
FIG. 3 is a side view of a further embodiment where the helmet carriers are slidably attached to the bag.
Figure 5:
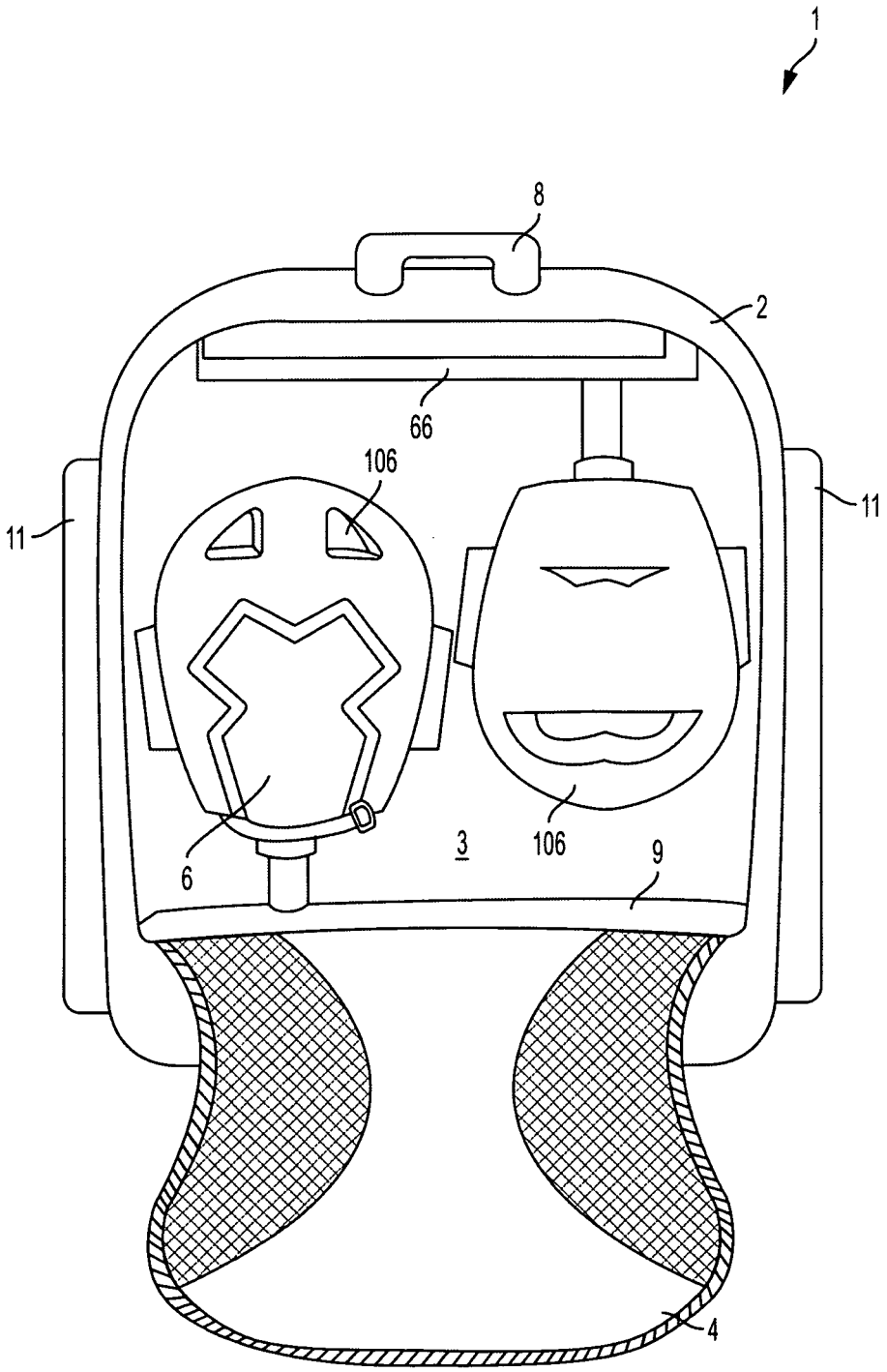
FIG. 5 is a front view of another further embodiment showing one helmet carrier attached to a base on the bottom of the bag and a second helmet attached to the top of the bag.

FIG. 1 shows the helmet carrier 6 is attached to the main compartment 3. FIG. 2 shows the helmet carrier 6 is pivotally attached to a framework 66 within the main compartment 3 of the housing 2. FIG. 3 illustrates the helmet carrier 6 is slidably attached to a framework 66 within the main compartment 3 of the housing 2. FIG. 5 shows the helmet carrier 6 is attached to the base 9 within the main compartment 3 of the housing 2.

Figure 4:
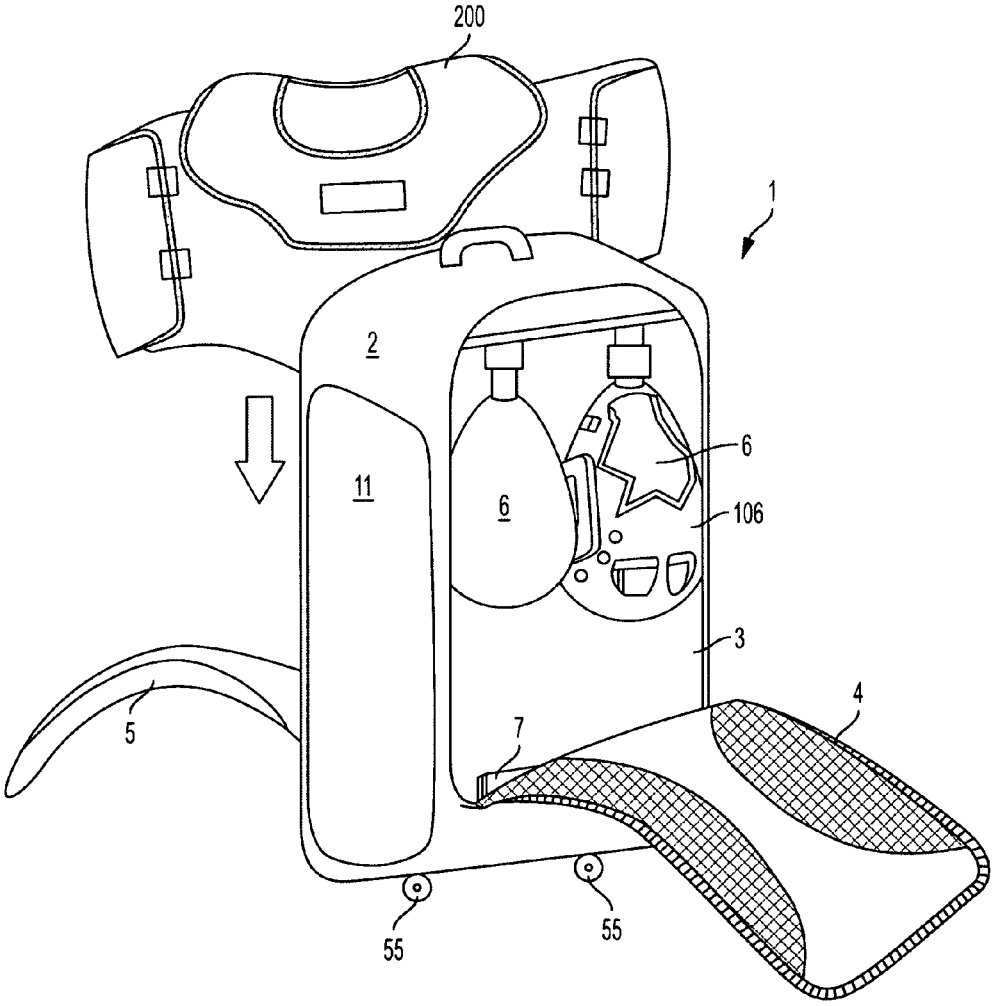
FIG. 4 is a front perspective view of FIG. 1 showing how the helmet and chest protectors are secured to the bag.

The bag 1 may further comprises at least secondary compartment 11, one wheel 55 (as shown in FIG. 4), at least one strap 88 (as shown in FIG. 3) and at least one handle 8.

The helmet carrier 1 is hollow, open up and provides for additional storage 600 (as shown in FIG. 1).

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A taekwondo bag comprising:

a housing comprising a main compartment and front and rear panels that close and open to access said main compartment, said main compartment comprising top and bottom portions;

at least one horizontal structure having at least one connector;

at least one helmet carrier attached to said connector and designed to receive an Olympic taekwondo helmet, said helmet carrier being situated within said main compartment of said housing of said bag, said helmet carrier contains a hollow cavity and replicates the shape of a full human head, at least a portion of said helmet carrier opens to provide access to said hollow cavity to provide access for storage.

2. The bag of claim 1 further comprising a second connector attached to said horizontal structure.

3. The bag of claim 2 further comprises a second helmet carrier, said second helmet carrier is attached to said second connector.

4. The bag of claim 1 wherein said connector is pivotally attached to said horizontal structure.

5. The bag of claim 1 wherein said connector is slidably attached to said horizontal structure.

6. The bag of claim 1 wherein at least a portion of said helmet carrier comprises at least one door to allow access to said cavity for storage.

7. The bag of claim 1 further comprises at least one secondary compartment.

8. The bag of claim 1 further comprises at least one handle for carrying said bag.

9. The bag of claim 1 further comprises at least one strap for carrying said bag.

10. The bag of claim 1 further comprises at least two straps for carrying said bag as a backpack.

11. The bag of claim 1 where a user accesses said rear panel to store the chest protector.

12. The bag of claim 1 further comprises at least one Olympic taekwondo chest protector and at least one Olympic taekwondo helmet.

13. The bag of claim 1 further comprises at least one closure.

14. The bag of claim 13 wherein said closure is a zipper.

15. The bag of claim 1 further comprises at least one wheel, at least one strap and at least one handle.

16. A taekwondo bag comprising:

a housing comprising a main compartment and a front panels that closes and opens to access said main compartment, said main compartment comprising top and bottom portions;

at least one horizontal structure in said main compartment having at least two connectors; and at least two helmet carriers, each attached to at least one of said connectors and designed to receive an Olympic taekwondo helmet, said helmet carriers being situated within said main compartment of said housing of said bag, said helmet carriers are in the shape of a human head and have hollow interiors, and at least a portion of said helmet carriers open to provide access to said hollow interiors for storage.

17. The bag of claim 16 further comprises a secondary compartment device designed to receive an Olympic taekwondo chest protector and a rear panel that provides access to said secondary compartment.

18. The bag of claim 16, wherein said helmet carriers are pivotally attached to said horizontal structure.

19. The bag of claim 16 further comprises a secondary compartment designed to receive an Olympic taekwondo chest protector and a rear panel that provides access to said secondary compartment.

20. A taekwondo bag comprising:

a housing comprising a main compartment and a front panels that closes and opens to access said main compartment, said main compartment comprising top and bottom portions;

at least two horizontal structures in said main compartment, each structure having at least two connectors, a first horizontal structure being situated adjacent said top portion of said main compartment and a second horizontal structure being situated adjacent said bottom portion of said main compartment; and at least two helmet carriers, each attached to at least one of said connectors and designed to receive an Olympic taekwondo helmet, said helmet carriers are in the shape of a human head and have hollow interiors, and at least a portion of said helmet carriers open to provide access to said hollow interiors for storage.

* * * * *